US005277514A

United States Patent [19]

Glickman

[11] Patent Number: 5,277,514

[45] Date of Patent: Jan. 11, 1994

[54] BLOCK FOR PAVING AND LIKE USES

[76] Inventor: Michael N. Glickman, 80 Lamble Street, London, NW5 4AB, England

[21] Appl. No.: 915,807

[22] PCT Filed: Jan. 17, 1991

[86] PCT No.: PCT/GB91/00071

§ 371 Date: Aug. 5, 1992

§ 102(e) Date: Aug. 5, 1992

[87] PCT Pub. No.: WO91/10779

PCT Pub. Date: Jul. 25, 1991

[30] Foreign Application Priority Data

Jan. 17, 1990 [GB] United Kingdom ..... 9001021

[51] Int. Cl.[5] ..... E01C 5/06

[52] U.S. Cl. ..... 404/41; 404/42

[58] Field of Search ..... 404/41, 42

[56] References Cited

FOREIGN PATENT DOCUMENTS 2407621 8/1975 Fed. Rep. of Germany ..... 404/42

3303210 8/1984 Fed. Rep. of Germany ..... 404/41

*Primary Examiner*—William P. Neuder

*Attorney, Agent, or Firm*—Renner, Otto, Boisselle & Sklar

[57] ABSTRACT

A paving block is made up, as seen in plan, of two connected portions (10, 12) one portion (10) comprising four connected substantially identical quadrants (14–17) and the other portion (12) having an inside-out pillow shape defined substantially by four arcuate surfaces. The curvature of each surface is substantially the same as that of the curved boundary of any one of the quadrants (14–17). Such a block may have various proportions, and may be made to various dimensions. However it is preferred for the blocks to be of such a size and weight that one can readily be held in one hand. This simplifies and makes less expensive the process of laying the blocks. Such blocks when laid have improved structural stability.

15 Claims, 5 Drawing Sheets

FIG.1.
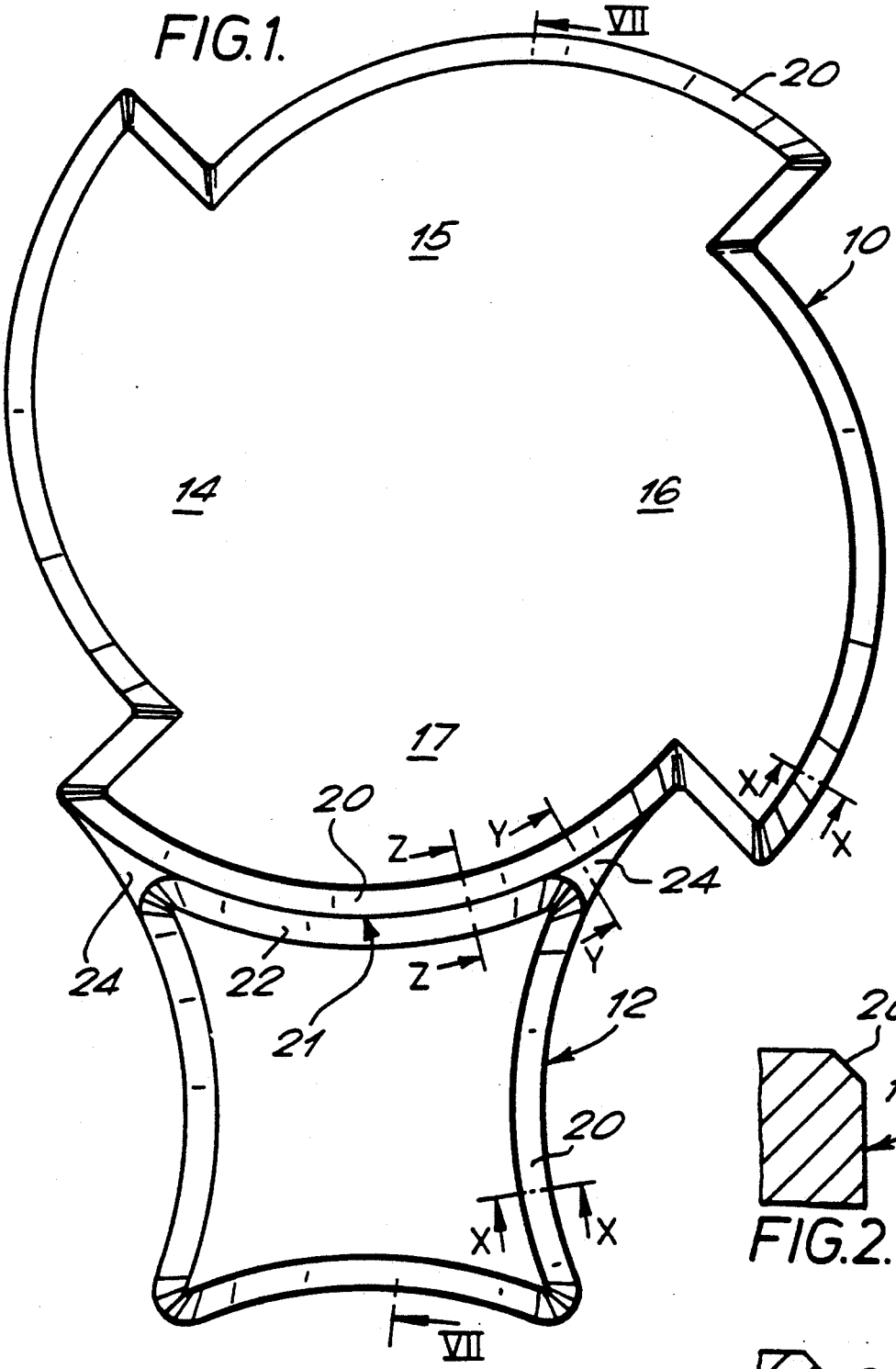
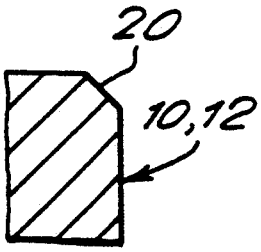
FIG.2.
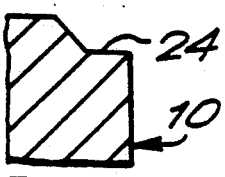
FIG.3.
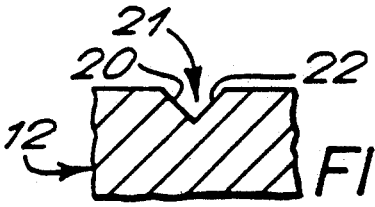
FIG.4.

BLOCK FOR PAVING AND LIKE USES

This invention relates to a block for paving and like uses, and particularly although not exclusively to a block made of concrete.

Many different designs of paving block are known. Two prior known designs were invented by the present inventor, and are disclosed in the British Patents Nos. EP(UK) 102214 and 2157335. There is a continuing demand for new paving blocks which is fuelled by residential demand and the increase in requirements and sophistication of organisations and local authorities who wish to pave public areas. The great majority of prior known paving blocks (including the blocks shown in the two patents cited above) are of generally rectilinear shape. In other words, their edges are in general defined by substantially straight lines. Disadvantages of most rectilinear blocks are that their structural stability when laid is less than desirable and they have a visual "sameness" and hence are uninteresting. When rectilinear laid blocks are subject to directional frictional forces, for example the effect of braking of vehicles moving in one direction, the lines of the blocks tend to bow, that is, become shallowly curved in a horizontal plane. In this specification the references to "horizontal" and "vertical" assume that the blocks are laid on a horizontal substrate but of course, as is well known, paving blocks can also be laid on sloping or curved surfaces.

When the lines of blocks tend to bow as mentioned above, the resulting surface has decreased stability and is less safe, and disruption and expense are involved in taking up and re-laying the blocks.

The present invention aims to provide a block which is an improvement over known blocks in this respect.

According to the present invention in one aspect, there is provided a paving block made up, as seen in plan, of two connected portions, one portion comprising four connected substantially identical quadrants and the other portion having an inside-out pillow shape substantially defined by four arcuate surfaces, the curvature of each surface being substantially the same as that of the curved boundary of any one of the quadrants.

According to another aspect of the invention, a paving block arrangement comprises two separate or separable parts, one such part consisting of four connected substantially identical quadrants and the other such part having an inside-out pillow shape as seen in plan substantially defined by four arcuate surfaces, the curvature of each surface being substantially the same as that of the curved boundary of any one of the quadrants.

A plurality of such arrangements can be laid to yield a pattern substantially identical to a pattern obtainable by laying blocks according to the first aspect of the invention mentioned above. When such an arrangement is laid, the two parts are laid in such a way that one of the curved sides of the inside out pillow shape block is placed closely adjacent to an arcuate surface defining the edge of a quadrant.

In a preferred version of the invention, the shape of the block as seen in plan is such that the quadrants are disposed in relation to each other such that one of the linear surfaces of each quadrant is adjacent to one side of a square centrally located with reference to the quadrants, and the other linear surface of that quadrant is adjacent to a linear surface of an adjacent quadrant.

Although references made herein to four quadrants, a square, and an inside-out pillow shape, all of these component parts are integral or permanently connected together to constitute a single block in the most preferred version of the invention. The block preferably has substantially planar upper and lower surfaces. Parts of the preferred block however are layered to form local depressions. In the alternative, or in addition, shallow grooves or channels may be cut in or otherwise provided in the upper surface. Such grooves or channels may be included to provide desired aesthetic effects.

A block according to the invention may have various proportions, and blocks according to the invention may be made to various dimensions. However it is highly preferred for blocks according to the invention to be of such a size and weight that one can readily be held in one hand. This simplifies and makes less expensive the process of laying the blocks.

An important advantage of blocks according to the invention is that a broken joint configuration is always achieved, and that the joint lines (which are never straight lines) are such that the laid paving has greatly improved resistance to "bowing" as described above. In other words, the laying configuration can be regarded as a staggered module configuration.

It is an interesting consequence of the design of blocks according to the invention that the resulting pattern of laid paying visible is substantially the same whether blocks according to the invention are laid in a running bond, or parquet, or herringbone style of pattern.

Blocks according to the invention or parts of a paving block arrangement as specified above may be readily and inexpensively made by conventional multi-mould methods of making concrete paving blocks.

Blocks, or paving block arrangements as specified above, according to the invention preferably have a maximum length dimension of about 250 mm and a maximum width dimension of about 160 mm. Their thickness may be from about 40 to about 100 mm. Of course blocks according to the invention are not limited to these particular dimensions. For example, a block of small thickness and made, for example of a synthetic plastics or ceramic material could be used as a wall tile, and in that event, the constraints upon maximum dimensions imposed by hand laying would not apply.

The variation possible in the proportions of the blocks according to the invention in essence arises because of the variety of possible relationships between the length of the side of the square located at the centre of the four quadrants, and the radius of each such quadrant. Desirably, for paving blocks, this ratio should be between 1:2.5 and 1:4.25. Preferably the same ratio should be between 1:3 and 1:4 and most preferably it should be about 1:3.75. In other words, for a block of overall width of about 150 mm, the length of the side of the square should be about 20 mm and the quadrant radius should be about 75 mm. As will be appreciated, however, the invention is not limited to these particular dimensions.

The invention will be better understood from the following description of a particular example, given with reference to the following non-limiting description and the accompanying illustrative drawings, in which:

FIG. 1 is a plan view of the presently preferred example of a block according to the invention;

FIG. 2 is a partial cross-section on the lines X—X of FIG. 1;

FIG. 3 is a partial cross-section on the lines Y—Y of FIG. 1;

FIG. 4 is a partial cross-section on the lines Z—Z of FIG. 1;

Figure 5:
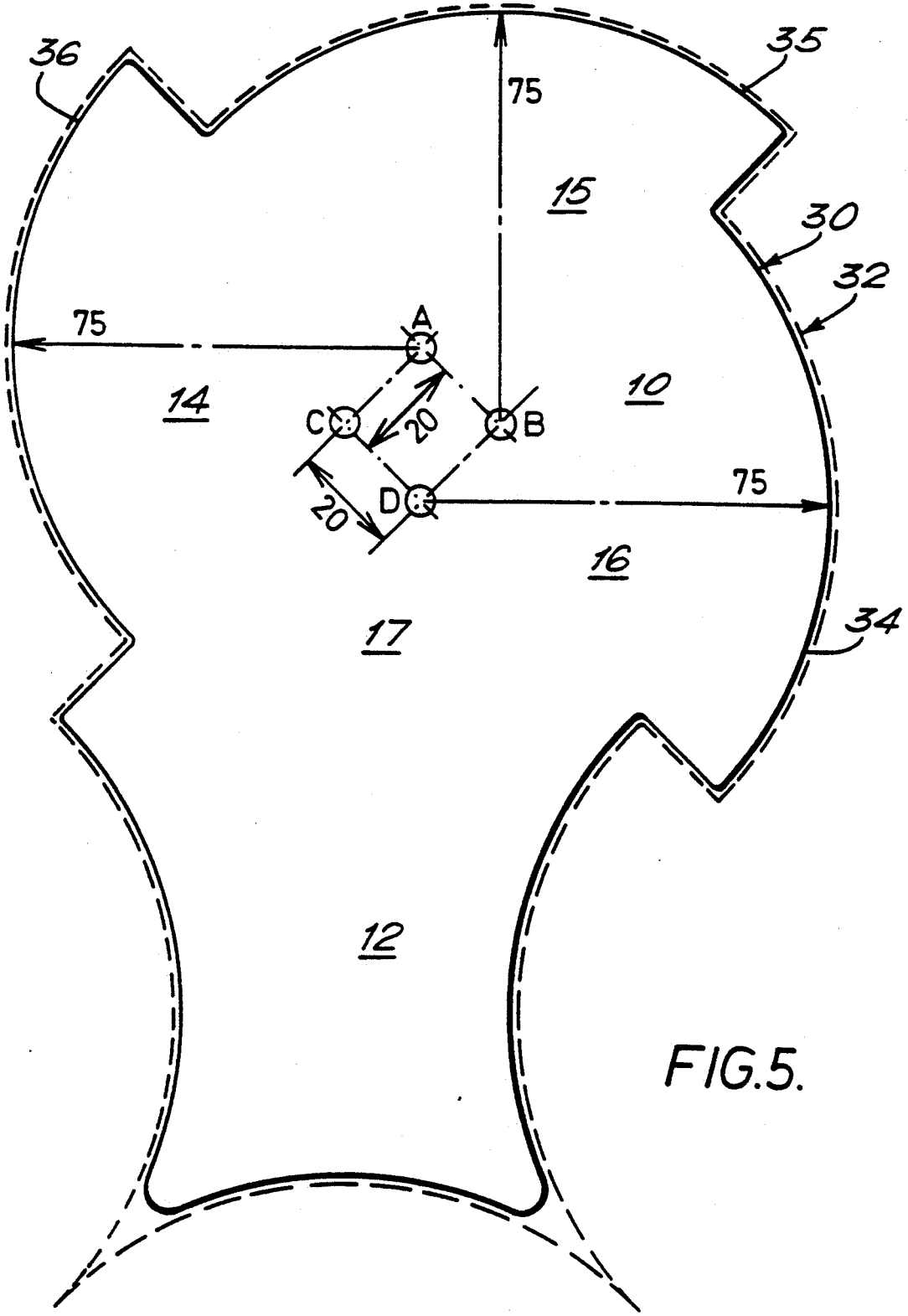
FIG. 5 is a plan view showing the principles of construction of a block in accordance with the present invention.

The preferred block according to the present invention illustrated in FIGS. 1-4 is made in one piece of concrete and has two connected portions 10 and 12, the portion 10 comprising four connected identical quadrants 14, 15, 16 and 17 and the second portion 12 having which has a shape which can be described as an inside-out pillow shape defined by four arcuate surfaces, the curvature of each such surface being the same as that of the curved surface of any one of the quadrants. As can be seen, the portion 10 is juxtaposed to the portion 10 and abuts it along the radial surface of one 17 of the quadrants. The outer upper edge of the block is shamphered as seen at 20. A V-groove 21 seen best in FIG. 4 is formed by surface 22 of the second portion 12 and surface 20 of the first portion 10. Substantially triangular portions 24 of the second portion 12 have flat substantially horizontal surfaces 24 as seen best in FIGS. 1 and 3.

Figure 6:
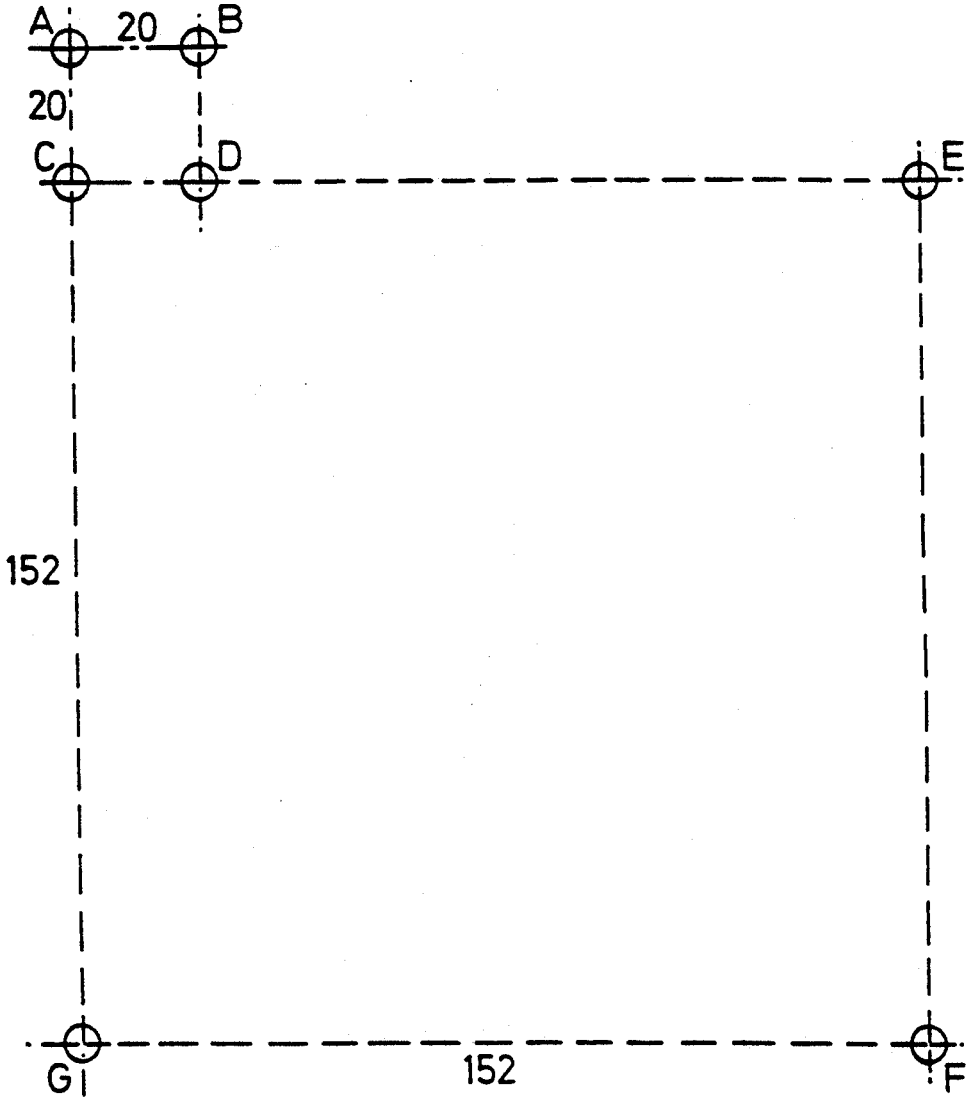
FIG. 6 is a diagram showing construction lines which will further assist understanding of FIG. 5.
Figure 7:
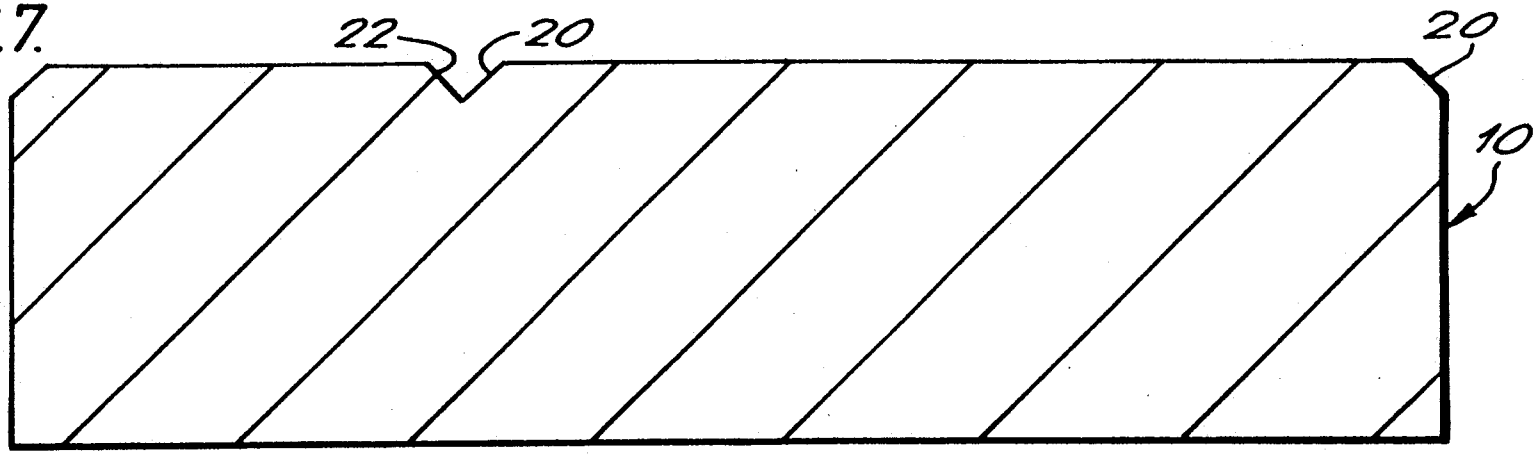
FIG. 7 is a vertical cross-section, on a slightly different scale, on the line VII—VII in FIG. 1.
Figure 8:
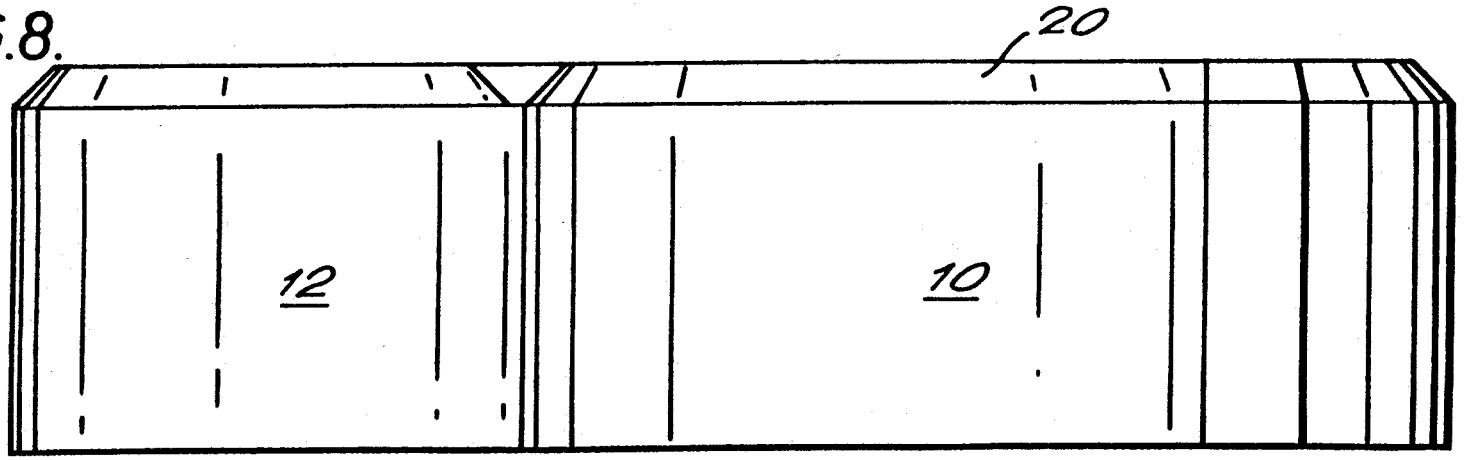
FIG. 8 is a side elevation, also on a slightly different scale, of the block shown in FIG. 1.

Referring now to FIGS. 5 and 6, the outer outline of the referred block according to the invention is arrived at by a method which will shortly be described. This outline is indicated at 30 in FIG. 5. As mentioned, the first portion 10 essentially is constituted by the four quadrants arranged around the square. The corners of the square are shown at A, B, C, D in FIG. 5. The length of the side of the square is indicated as, for example, 20 units. Each quadrant, as indicated, has a radius of 75 units. The repeating module which is in effect the tesselation pattern of the laid paving blocks is indicated by the dotted line 32, and as will be seen the radii of this are one unit larger on a convex radius and one unit smaller on a concave radius than the intended size of the resulting moulded concrete block.

FIG. 6 illustrates the relationship between the respective centres of curvature of the curved edges or boundary surfaces of blocks according to the invention, the centres of the four quadrants 14, 15, 17, 16, respectively being A-D as seen in FIG. 6. E, F, and G are the respective centres by which the curved surfaces defining the second portion 12 are arrived at. In other words the arcuate surfaces 34, 35 and 36 are formed by arcs struck from centres D, B, and A. The centre C is that used to define the arcuate boundary of the quadrant 17 which is connected to the second portion 12.

Figure 9:
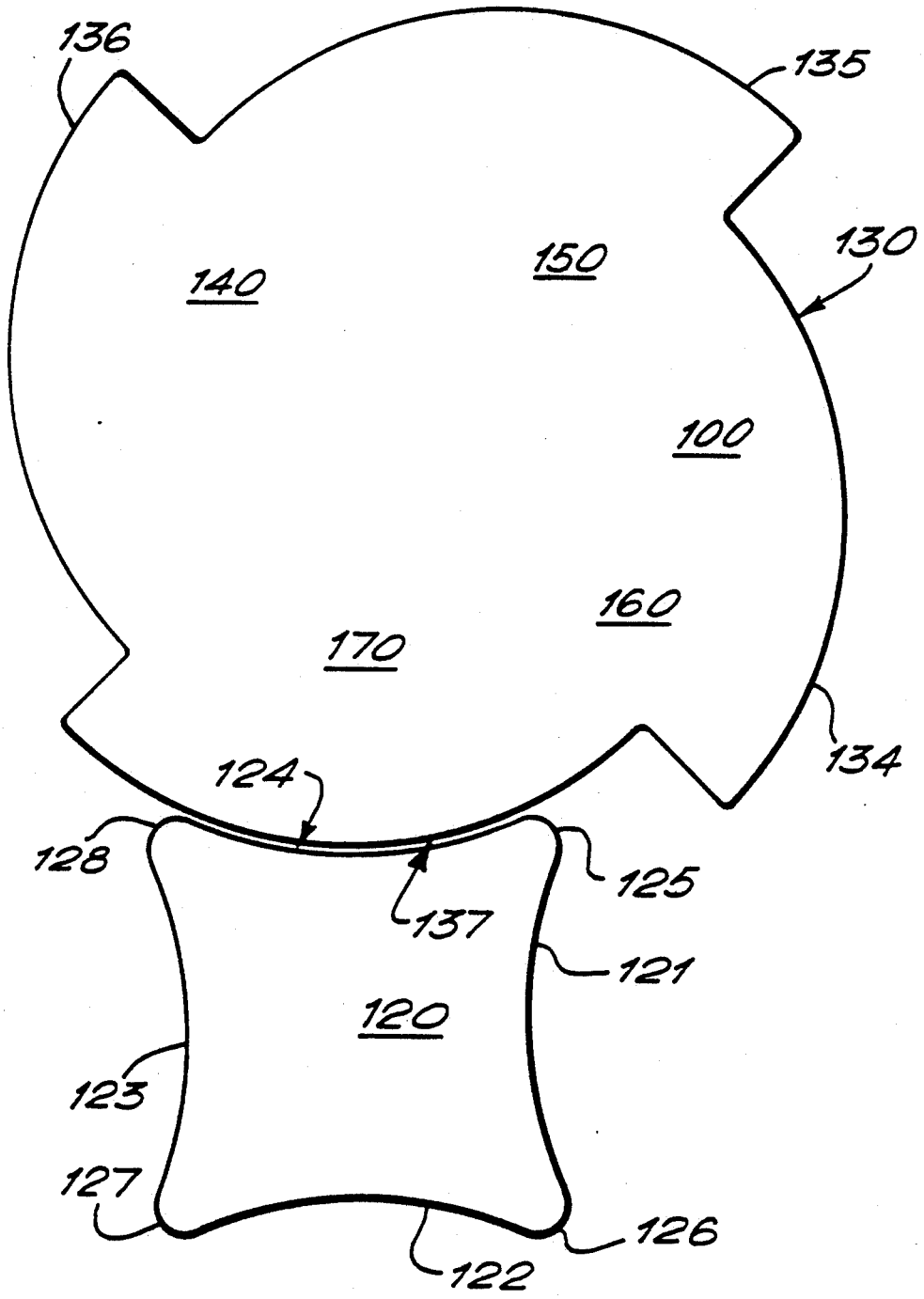
FIG. 9 is a diagrammatic plan view of a 2-block paving block arrangement according to an alternative embodiment of the invention.

An alternative embodiment of the invention is shown in FIG. 9. A paving block arrangement is made up of two separate blocks 100 and 120. The block 100 is composed, as seen in plan, of four quadrants 140, 150, 160, 170 arranged around a notional square ABCD. Each quadrant is partly bounded by a circular arc 134-137. The block 120 is of a shape herein called inside-out pillow shape. It is defined by four arcuate sides 121-124. The radii of curvature of the sides 121-124 are equal, and are substantially equal to the radii of curvature of the arcs 134-137. As seen, the side 124 is arranged closely adjacent to arc 137. The two blocks 100, 120, so arranged, are equivalent in function to the block illustrated in FIGS. 1-4. The blocks 100 and 120 preferably have equal thickness. The edges of both blocks 100, 120 may be, but need not be, chamfered or radiused.

The four extremities 125-128 of the block 120 are preferably all similarly radiused. This is desirable because it avoids parts of the block being broken off in handling or transport. Due to the diagrammatic nature of FIG. 9 the extremities may appear dissimilar but the preferred configuration has identical radiusing.

It will be seen that the invention as particularly disclosed and illustrated in FIGS. 1-8 herein provides a block, useful principally for paving but possibly useful also as a wall tile or a decorative block which has important structural, operational and aesthetic features. Such a block can be laid in patterns of attractive appearance. The laid paving has favourable structural characteristics and can be laid in a choice of different laying patterns.

The paving block arrangement according to FIG. 9 yields substantially the same advantages that are provided by the FIG. 1 block.

I claim:

1. A paving block having substantially flat and parallel top and bottom surfaces, the block being made up, as seen in plan, of two connected portions, one portion comprising four connected substantially identical quadrants, each such quadrant being defined by two notional linear boundaries of equal length at right angles to each other which meet at a point, the distal ends of these notional linear boundaries being joined by a curved boundary which is an arc of a circle, and the other portion having a shape defined by four arcuate and concave surfaces of equal length, the curvature of each surface being substantially the same as that of the said curved boundary of any one of the quadrants, the said other portion being disposed in relation to the said one portion such that one of said arcuate surfaces thereof is in juxtaposition with one of said curved boundaries, the quadrants being disposed in relation to each other such that one of the notional linear boundaries of each quadrant is collinear with one side of a notional square centrally located with reference to the quadrants, and the other notional linear boundary of that quadrant is collinear with a notional linear surface of an adjacent quadrant.

2. A block according to claim 1 which is made of concrete and is of a size that can easily be held in a human hand.

3. A block according to claim 1 in which the upper surface or surfaces have grooves or channels therein.

4. A block according to claim 1 in which the ratio between the length of the side of the square located at the centre of the four quadrants to the radius of each quadrant is from 1:2.5 to 1:4.25.

5. A block according to claim 4 in which the said ratio is 1:3 to 1:4.

6. A block according to claim 5 in which the said ratio is about 1:3.75.

7. A paving block arrangement comprising two separate parts each of which has substantially flat and parallel top and bottom surfaces, the two parts being of substantially equal thickness, one such part consisting of four connected substantially identical quadrants, each such quadrant being defined by two notional linear boundaries of equal length at right angles to each other which meet at a point, the distal ends of these notional linear boundaries being joined by a curved boundary which is an arc of a circle, and the other such part having, as seen in plan, a shape substantially defined by four arcuate surfaces, the curvature of each surface being substantially the same as that of the curved boundary of any one of the quadrants, the quadrants of said one part being disposed in relation to each other such that one of the linear boundaries of each quadrant is collinear with one side of a notional square centrally located with reference to the quadrants, and the other notional linear boundary of that quadrant is collinear with a notional boundary of an adjacent quadrant.

8. A block according to claim 7 in which the ratio between the length of the side of the square located at the centre of the four quadrants to the radius of each quadrant is from 1:25 to 1:4.25.

9. A block according to claim 8 in which the said ratio is from 1:3 to 1:4.

10. A block according to claim 9 in which the said ratio is about 1:3.75.

11. An arrangement according to claim 7 in which each of the two component parts is of a size that can easily be held in a human hand.

12. A paving block having substantially flat and parallel top and bottom surfaces, the block comprising four connected substantially identical quadrants, each such quadrant being defined by two notional linear boundaries of equal length at right angles to each other which meet at a point, the distal ends of these notional linear boundaries being joined by a curved boundary which is an arc of a circle, and the quadrants being disposed in relation to each other such that one of the notional linear boundaries of each quadrant is collinear with one side of a notional square centrally located with reference to the quadrants, and the other notional linear boundary of that quadrant is collinear with a notional linear surface of an adjacent quadrant.

13. A block according to claim 12 in which the ratio between the length of the side of the square located at the centre of the four quadrants to the radius of each quadrant is from 1:2.5 to 1:4.25.

14. A block according to claim 13 in which the said ratio is from 1:3 to 1:4.

15. A block according to claim 14 in which the said ratio is about 1:3.75.

* * * * *